US005467759A

United States Patent [19]

Troncoso

[11] Patent Number: 5,467,759

[45] Date of Patent: Nov. 21, 1995

[54] ARCHERY REST ASSEMBLY

[75] Inventor: Vincent F. Troncoso, Montrose, Colo.

[73] Assignee: Golden Key Futura, Inc., Montrose, Colo.

[21] Appl. No.: 370,100

[22] Filed: Jan. 9, 1995

[51] Int. Cl.[6] ..... F41B 5/22

[52] U.S. Cl. ..... 124/44.5; 124/24.1

[58] Field of Search ..... 124/24.1, 44.5, 124/86, 88

[56] References Cited

U.S. PATENT DOCUMENTS

| | | | |
|---|---|---|---|
| 4,236,497 | 12/1980 | Troncoso . | |
| 4,748,964 | 6/1988 | Troncoso | 124/44.5 |
| 4,827,895 | 5/1989 | Troncoso | 124/44.5 |
| 5,070,855 | 12/1991 | Troncoso | 124/44.5 |
| 5,144,937 | 9/1992 | Colvin | 124/44.5 |
| 5,245,980 | 9/1993 | Colvin | 124/24.1 |
| 5,251,606 | 10/1993 | Colvin | 124/44.5 |

*Primary Examiner*—John A. Ricci
*Attorney, Agent, or Firm*—Donald E. Nist

[57] ABSTRACT

The improved assembly includes an arrow shaft support, preferably in the form of a twisted elongated blade, connected at its rear end to the free end of a transverse cross-bar, the intermediate portion of which is received for rotation in the lower portion of a depending bracket. The upper portion of the bracket holds the rear end of an arrow shaft side pressure arm preferably similar to the support and which extends forwardly and diagonally to a point adjacent the front end of the support. The bracket bears a tubular extension which passes transversely through the rear portion of an elongated mounting block, the front portion of which is adapted to be secured to the sidewall of an archery bow riser so that the assembly extends behind the arrow window in the bow. A guide rod passes from the bracket transversely through the block and is spaced from the tubular extension to prevent rotation of the bracket. A turn knob is fitted over the extension end so that the bracket, arm and support can be moved incrementally towards and away from the block. A shaft and spur interconnect the cross-bar intermediate portion and side pressure point arm for simultaneous movement of the arm away from the support when the support is depressed, providing arrow clearance during shooting. The support and arm are adjustably spring biased to improve arrow flight from the assembly.

5 Claims, 1 Drawing Sheet

ARCHERY REST ASSEMBLY

BACKGROUND OF THE INVENTION

FIELD OF THE INVENTION

The present invention generally relates to sports equipment and more particularly to a novel arrow rest assembly for archery bows.

PRIOR ART

Various types of arrow rests have been used in archery bows. Earlier types of rests were merely shelves connected to the sidewall of the riser section of the archery bow and projecting horizontally out into the arrow window. No side pressure points were provided against which the side of the arrow shaft could rest while seated on the arrow rest. Instead, the arrow shaft was positioned close to or abutting the sidewall.

Problems were encountered with such an arrangement since, despite the so-called archer's paradox, the arrow shaft frequently caused the rear feathers or vanes on the arrow to strike hard against the bow sidewall, wearing the feathers and vanes and greatly deflecting the arrow from the desired path toward the target.

Later developments included rests with fixed or depressible side pressure points. In some instances, the side pressure points were added separately to the bow and were not connected to the rests. Such pressure points as were provided in most instances were non-adjustable and not retractable. Accordingly, they still were struck by the arrow and damaged and deflected it. Those which were retractible frequently could not move out of the way of the arrow rapidly enough to avoid striking them. Others depended on the arrow itself pushing the side pressure point out of the way, again an unsatisfactory arrangement.

The situation is more critical when mechanical bowstring releases are used to shoot the bows and/or the bows are compound bows with great bowstring force being delivered to the arrow shaft during shooting. Such devices generally cause the arrow shaft to bend less and often have little clearance between the arrow and the bow sidewall, thus increasing chances of the arrow striking the sidewall during shooting.

Another problem has also arisen. Modern archers usually utilize various types of arrows with various diameters, bendabilities, etc. for different types of archery, including hunting and target shooting. The use of different arrows requires changing the clearance of the arrows from the bow sidewall, and changing the depressibility of the rests and the resistance of the side pressure points in order to properly tune the bow to allow it to shoot the arrow with accuracy.

Current rests and side pressure point devices are incapable of such a wide range of adjustments. Accordingly, both the rests and the side pressure point devices must be changed when major changes are made in the types of arrows used. This is expensive, time-consuming and frustrating, impeding the ability of the archer to properly tune the bow.

Accordingly, there is a need for an improved type of arrow rest assembly which will permit the rest and side pressure point device to be adjusted as to position in the arrow window and also with respect to the resistance of the rest and side pressure device. Such an assembly should enable an archer to finely tune a bow, regardless of the type of arrow used, without removing either the rest or side pressure device.

SUMMARY OF THE INVENTION

The improved archery arrow rest assembly of the present invention satisfies all the foregoing needs. The assembly is substantially as set forth in the ABSTRACT OF THE DISCLOSURE.

The assembly is durable, inexpensive and highly efficient. It enables the archer to change both the location of the arrow support and the side pressure point device in the arrow window and also the degree of depressibility of the support and degree of resistance of the side pressure point device. Moreover, it provides a unique feature in that as the arrow support is depressed by the downward force of the arrow as it is shot from the bow, the side pressure portion of the assembly automatically moves away from the support, increasing the arrow clearance and assuring that the shaft and feathers or vanes of the bow will not strike the side pressure portion and cause deflection and wear of the arrow.

In the assembly of the present invention, the arrow support is connected at its rear end to the free end of a transverse cross-bar which passes through a depending bracket. The bracket is connected to the rear portion of a mounting block, the front end of which is attachable to the bow sidewall in the riser section. The block extends rearwardly of the bow so that the cross-bar and bracket are behind the arrow window.

The bracket includes a pair of spaced bars disposed through the block to stabilize the bracket against rotation and to permit the bracket to be incrementally moved towards and away from the block and thus shift the position of the support in the arrow window. The bracket also includes at its upper end a side pressure point blade or the like which projects forwardly to a position adjacent the front end of the support on the side thereof facing the sidewall.

The side pressure point blade is connected for horizontal rotation to a vertical shaft in the bracket, the lower end of which shaft intercepts the intermediate portion of the cross-bar through a projecting spur. This arrangement causes the side pressure point blade to automatically rotate out of the arrow's path when the support is depressed by the arrow during shooting.

Spring pressure resisting depression of the support and movement of the side pressure blade is achieved through the use of a spring keyed both to a turn cap disposed over the opposite end of the cross-bar and to the bracket. A lock nut locks the turn cap to the cross-bar, thus transferring spring pressure to it. This pressure is adjustable to a preselected reproducible degree by twisting the spring with the turn cap before locking the latter in place against the cross-bar.

Preferably, both the side pressure blade and support are elongated metallic strips twisted for added strength and stability. Further features of the improved assembly of the present invention are set forth in the following detailed description and accompanying drawings.

DRAWINGS

DETAILED DESCRIPTION

Figure 1:
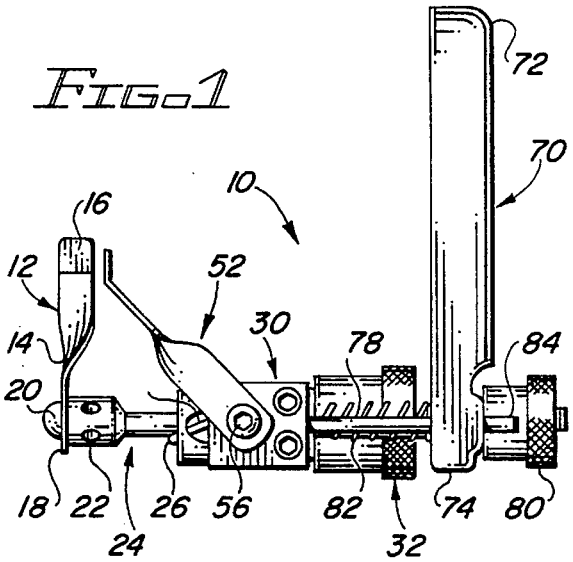
FIG. 1 is a schematic top plan view of a preferred embodiment of the improved archery arrow rest assembly of the present invention.
Figure 2:
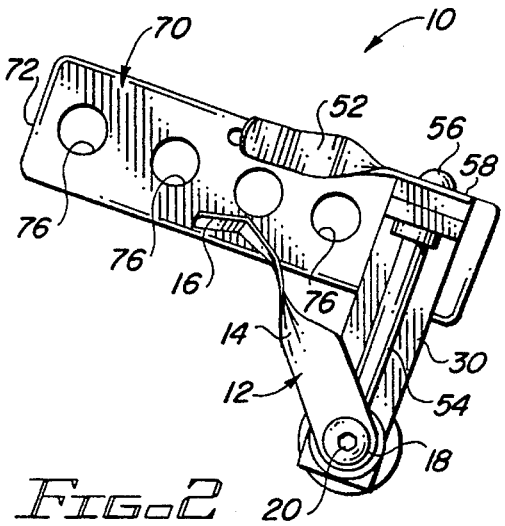
FIG. 2 is a schematic left side elevation of the assembly of FIG. 1.

FIGS. 1–5.

Now referring more particularly to the accompanying drawings, FIGS. 1–5 schematically depict a preferred embodiment of the improved archery arrow rest assembly of the present invention. Thus, assembly 10 is shown, which includes an arrow shaft support 12 in the form of an elongated twisted blade 14 of thin metal such as steel or the like, the front end 16 of which is adapted to seat the shaft of an archery arrow (not shown) thereon and the rear end 18 of which is releasably connected, as by screw 20 to the free end 22 of a transverse generally cylindrical cross-arm 24 having an intermediate portion 26 and an opposite end 28.

Intermediate portion 26 passes transversely through and is received for rotation in a generally vertical depending bracket 30, while opposite end 28 of cross-bar 24 is disposed on the side of of bracket 30 which is away from support 12 and is provided with a turn cap 32 slideably disposed thereover for rotation.

Figure 5:
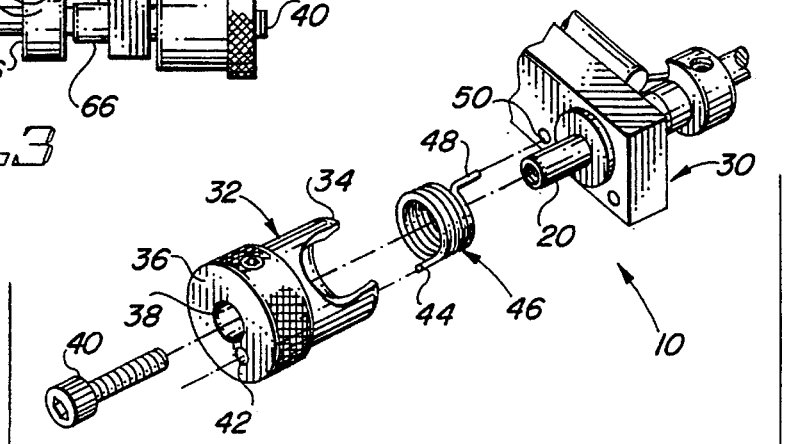
FIG. 5 is a schematic, fragmentary exploded perspective view of the adjustable spring tension portion of the assembly of FIG. 1.

As is shown particularly in FIG. 5, turn cap 32 has a hollow front portion 34 and a closed rear wall 36, the latter bearing a central opening 38 through which the shaft of a lock screw 40 can extend, and a second opening 42 through which end 44 of a coiled spring 46 is releasably received. The opposite end 48 of spring 46 is releasably received in an opening 50 in the side of bracket 30. Spring 46 slides over end 28 of cross-bar 24, which end 28 is threaded to receive the shaft of lock screw 40.

When turn cap 32 and spring 46 are in the assembled but unlocked position, turn cap 32 can be rotated to any desired reproducible degree so as to increase the rotational resistance exerted by spring 46 on turn cap 32. This spring resistance is then transferred to cross-bar 24 by locking turn cap 32 to end 28 of cross-bar 24 by screw 40. The net effect is to increase to any desired degree the spring resistance of support 12 against downward movement thereof by an arrow during shooting of the arrow from support 12.

Assembly 10 also includes a side pressure point blade 52 releasably secured to a vertical shaft 54 in the top of bracket 30, as by screw 56. Blade 52 may be of twisted metal such as steel or the like or of another material offering requisite strength and dimensional stability. Blade 52 has its rear end 58 fixed to shaft 54 and projects forwardly and diagonally therefrom to a point near front end 16 of support blade 14 but to the side thereof between blade 14 and bracket 30.

Figure 3:
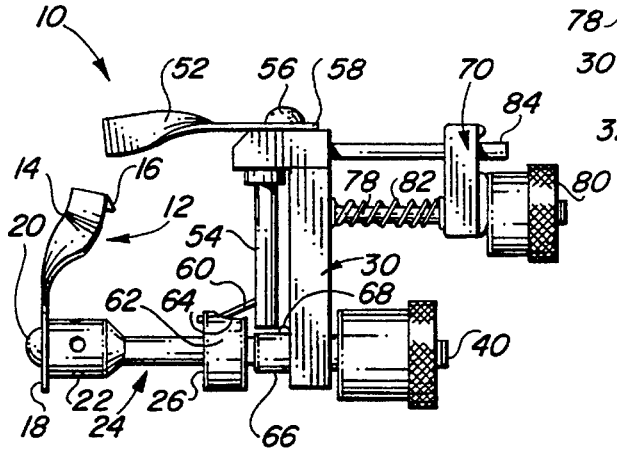
FIG. 3 is a schematic rear elevation of the assembly of FIG. 1.
Figure 4:
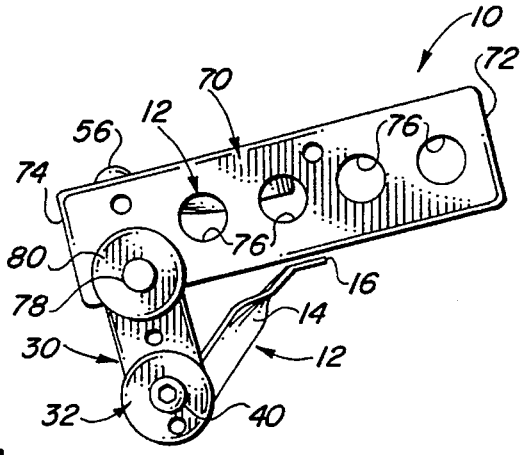
FIG. 4 is a schematic right side elevation of the assembly of FIG. 1.

Shaft 54 extends down in bracket 30 to a point adjacent crossbar 24 and bears a generally laterally extending spur 60 which intercepts cross-bar 24 through a circular disc 62 fixed around cross-bar 24 and bearing an interception slot 64 therein. With this arrangement, blade 52 is keyed to blade 14, so that downward movement of blade 14 during arrow shooting automatically produces movement of blade 52 away from blade 14, thereby increasing automatically the clearance of the arrow from blade 52, preventing the arrow from striking blade 52. Thus, rotation of cross-bar 24 around a horizontal axis is translated to rotation of shaft 54 around a vertical axis. Bracket 30 may also bear a fixed collar 66 adjacent the lower end of shaft 54, which collar carries a detent 68 to prevent wobbling of the free lower end of shaft 54, as shown in FIG. 3.

Assembly 10 also includes an elongated generally rectangular mounting block 70 having a front portion 72 and rear portion 74. Front portion 72 defines a plurality of overlapping holes 76 disposed transversely therethrough for adjustably mounting block 70 to the sidewall of an archery bow in the riser section thereof adjacent the arrow window so that block 70 extends rearwardly of the bow to a point behind the window.

Bracket 30 bears an elongated tube 78 which extends transversely through block 70 and has a free end (not shown) over which a turn knob 80 is threaded so that bracket 30 can be incrementally moved towards and away from block 70 by turning knob 80 in the appropriate direction. A coiled spring 82 around tube 78 maintains a controlled resistance on such movement. Bracket 30 also includes a guide rod 84 which is above tube 78 and also extends transversely through block 70. Rod 84 prevents rotation and wobbling of bracket 30 during its use.

Block 70 supports bracket 30 and, in turn, cross-bar 24 and support 12 so that support 12 and blade 52 extend an adjustable distance into the arrow window of the bow from the rear of the window. By loosening and tightening the appropriate screws, both blade 14 and blade 52 can be adjusted with respect to their angles into the arrow window and their relative positions with respect to each other, to further facilitate tuning of a bow using assembly 10.

Assembly 10 can be made of any suitable materials and in any suitable size. Preferably, anodized aluminum, brass, steel and/or stainless steel components are used for improved durability and dimensional stability. Assembly 10 has improved adjustability and adaptability over conventional arrow rests and side pressure point devices, as set forth herein.

Various modifications, changes, alterations and additions can be made in the improved assembly of the present invention, its components and parameters. All such modifications, changes, alterations and additions as are within the scope of the appended claims form part of the present invention.

What is claimed is:

1. An improved archery arrow rest and side pressure point assembly, said assembly comprising, in combination:

a) an archery arrow shaft support having a front end adapted to support an arrow shaft and an opposite rear end;

b) a transverse cross-bar having a free end, an intermediate portion and an opposite end, said free end being releasably connected to the rear end of said support, for projecting said support forwardly into the window of an archery bow, said cross-bar being generally circular in transverse cross-section;

c) a bracket having an upper portion and a lower portion, said bracket receiving said intermediate portion of said cross-bar for rotation of said cross-bar therein;

d) a forwardly and rearwardly extending elongated mounting block having a front portion and a rear portion, said block front portion being adapted to be secured to the sidewall of the riser section of an archery bow, said sidewall defining said window on the side thereof facing said bracket and said arrow shaft support, said block rear portion being adapted to extend rearwardly of said riser section;

e) a tubular arm connected to the side of said bracket facing said block and extending transversely through said block rear portion;

f) guide means connected to said bracket and spaced from said tubular arm, said guide means passing transversely through said block rear portion to prevent rotational movement of said bracket;

g) a turn knob rotatably connected to said tubular arm on the side of said block facing away from said arrow shaft support for incremental transverse movement of said bracket and support towards and away from said block for adjustable lateral positioning of said support in said window;

h) an arrow shaft side pressure arm having a front end and a rear end, said arm rear end being releasably connected to said bracket above said arrow shaft support; and, i) connector means in said bracket interconnecting said intermediate portion of said cross-bar and said rear end of said side pressure point arm, whereby depressing of said support during shooting of an arrow shaft therefrom simultaneously effects movement of said front end of said arm towards said sidewall, providing automatic arrow clearance during said shooting.

2. The improved assembly of claim 1 wherein said assembly includes a turn cap slideably received over said opposite end of said cross-bar for rotation therearound, a spring releasably connected to said turn cap and said bracket and a lock releasably locking said turn cap to said opposite end of said cross-bar, said spring applying rotational bias to said crossbar and said support, which bias is adjustable by rotation of said turn cap a preselected degree before locking said turn cap to said cross-bar.

3. The improved assembly of claim 2 wherein said guide means includes an elongated rod.

4. The improved assembly of claim 2 wherein said bracket is elongated and depends below said block, and wherein said connector means comprises a depending shaft in said bracket fixedly secured to said arm for rotation therewith and extending down to a point adjacent said cross-bar intermediate portion, said shaft lower portion including a connector spur extending laterally thereof into connection with said cross-bar intermediate portion, whereby rotation of said cross-bar around a horizontal axis effects simultaneous rotation of said shaft around a vertical axis for simultaneous movement of said arm and support.

5. The improved assembly of claim 4 wherein said arm is angled toward said front end of said support and wherein said support and arm comprise elongated blades twisted for improved strength and stability.

* * * * *